US005944992A

United States Patent [19]

Nemedi et al.

[11] Patent Number: 5,944,992

[45] Date of Patent: Aug. 31, 1999

[54] CENTRIFUGE SEPARATOR

[75] Inventors: William D. Nemedi; Robert J. Nemedi, both of Kalamazoo, Mich.

[73] Assignee: Inter-Source Recovery Systems, Inc., Kalamazoo, Mich.

[21] Appl. No.: 08/926,838

[22] Filed: Sep. 10, 1997

[51] Int. Cl.[6] ..... B04B 1/04

[52] U.S. Cl. ..... 210/373; 210/380.1; 494/43; 494/74

[58] Field of Search ..... 210/232, 380.1, 210/373, 498, 499, 377; 494/36, 43, 45, 58, 74

[56] References Cited

U.S. PATENT DOCUMENTS

| | | | |
|---|---|---|---|
| Re. 35,307 | 7/1996 | Nemedi | 494/43 |
| 1,916,393 | 7/1933 | Smith | 210/498 |
| 3,957,652 | 5/1976 | McGonigal | 210/232 |
| 4,186,096 | 1/1980 | Areaux et al. | 210/377 |
| 4,936,822 | 6/1990 | Nemedi | 210/373 |
| 5,252,208 | 10/1993 | Nemedi | 210/373 |
| 5,275,727 | 1/1994 | Nemedi | 210/373 |
| 5,330,637 | 7/1994 | Nemedi | 210/232 |

*Primary Examiner*—David A. Reifsnyder
*Attorney, Agent, or Firm*—Marshall, O'Toole, Gerstein, Murray & Borun

[57] ABSTRACT

The invention relates generally to a screen used for separating lubricants from solid materials, and more particularly, to a centrifugal parts separator having a screen which assists in separating lubricants from metal or other scrap materials. The screen of the present invention preferably comprises a cylindrical shaped member which can be formed in one or more component parts with a plurality of spaced fluid passage openings therein. The screen is made so that the ratio of the distance between the openings to the median width of the openings is at least 18/1, thereby providing increased surface wear area of the screen.

18 Claims, 2 Drawing Sheets

CENTRIFUGE SEPARATOR

FIELD OF INVENTION

The invention relates generally to a screen used for separating lubricants from solid materials, and more particularly, to a centrifugal parts separator having a screen which assists in separating lubricants from metal or other scrap materials. More specifically, the invention is directed to a separator screen in which fluid passage openings in a screen are spaced an optimal distance from one another to substantially reduce screen wear.

BACKGROUND OF THE INVENTION

Centrifuge separators are commonly used to separate lubricants from metal chips or other materials impregnated with lubricating or other fluids. The centrifuge separator device includes a separator bowl with a plurality of spaced blades fixed to the bowl. A substantially cylindrical porous separator screen defined by wire mesh or closely spaced steel bars have openings sufficient to permit passage of lubricant or other fluid therethrough is attached to the top of the bowl.

In a typical operation, metal chips and lubricating fluids to be separated are delivered to the centrifuge. The mixed chips and fluids pass into the rotating separator bowl where the materials are forced outwardly and upwardly along the internal bowl wall and the leading surface of the blades. As the metal chips and fluid pass over the screen, the lubricating fluid separates from the chips as it passes through the screen openings to a lubricating fluid collection chamber. The separated metal chips cannot pass through the screen openings but rather travel upward on the screen surface following which they are blown out of an exit chute to a collecting site.

Unfortunately, separator screens presently used in separator devices are not entirely satisfactory. It has been found that the screens wear relatively quickly as chip materials of certain alloys walk over the screen surface, the chip materials often being quite hard or otherwise abrasive. Indeed, when the centrifuge is operating, the solid material from the fluid travels along the height of the screen contacting the screen surface under heavy pressure created by the action of the centrifuge causing excessive screen wear. One potential solution is to use a harder, more wear-resistant material to fabricate the screen. However, the harder the material, the more difficult and costly it becomes to fabricate the screen. Therefore, any improvement in wear-resistance provided by the harder material may be offset by the increased cost of the screen.

Another disadvantage is that a screen used with a centrifuge separator presently available is relatively costly due to the screen material and the procedure used to make a screen. Screens presently used often are formed by first providing a number of drawn or extruded bars. The bars are notched on the back surface. Thereafter, the notched bars are placed in a form whereby the requisite spacing between bars is carefully arranged to form the desired fluid passage openings. Once the bars are aligned in their appropriate positions, a cross rod is placed in the notches and welded to the bars to complete the screen fabrication. One can appreciate that the time and effort associated with making a screen of this type, often referred to as a "wedge wire" screen, are quite significant such that the screen in a conventional parts separator device constitutes a costly component.

What is desired is to have a screen which has increased wear-resistance over screens presently available. Moreover, it is desired to, if possible, cast or fabricate the screen such that different sizes and shapes of spaces such as slots be provided in the screen without the labor intensive costs presently associated with making conventional screens.

SUMMARY OF THE INVENTION

The invention disclosed and claimed herein serves to obviate the problems associated with screens presently available and further achieves the desires sought for a separator screen over which a fluid and solid material passes.

Briefly, the invention disclosed and claimed herein involves a screen which can be cast, if desired. Further, the costly time and effort associated with fabricating a conventional screen is obviated. The screen of the present invention preferably comprises a cylindrical shaped member which can be formed in one or more component parts. The screen is made so that the spacing between fluid passage openings is maintained at a ratio of x/y, where "x" represents the distance between the center line from one opening to the center line of an adjacent opening, and "y" is the median screen opening width. A ratio in excess of about 18/1 and preferably 100/1, as measured on the wear wall of the screen, is desired. A screen employing such a ratio has been found to provide an increased surface wear area over which fluids and solids travel across the screen. The screen with its increased solid (as opposed to slot) surface area serves to reduce the wear previously incurred with conventional screens inasmuch as the centrifuged solids travel across an increased surface area not heretofore previously available.

Further, the screen can be cast or fabricated in one piece or, if desired, the screen can be formed of a plurality of screen segments. When made in one piece, the screen can be made sufficiently flexible such that it can be wrapped in a circular shape to fit into a centrifuge. Further, the screen of the present invention can be formed with a plurality of slots or openings of differing shapes. Because the screen can be cast or fabricated with the desired surface distance/opening width ratio, the need for forming a screen out of a plurality of drawn bars is obviated.

The screen of the present invention serves to reduce screen wear presently existing with conventional screens. Moreover, while the application for the screen is the separation of chip materials and lubricant, it is appreciated that the screen can be used in other applications as, for example, where water or other fluids along with solid materials pass over a screen and it is desired to separate the fluid from the sludge or other centrifuged materials as the conglomerate travels or walks over the screen.

BRIEF DESCRIPTION OF THE DRAWINGS

Further advantages of the invention will become apparent upon a reading of the following detailed description taken in conjunction with the accompanying drawings in which.

DETAILED DESCRIPTION

Figure 1:
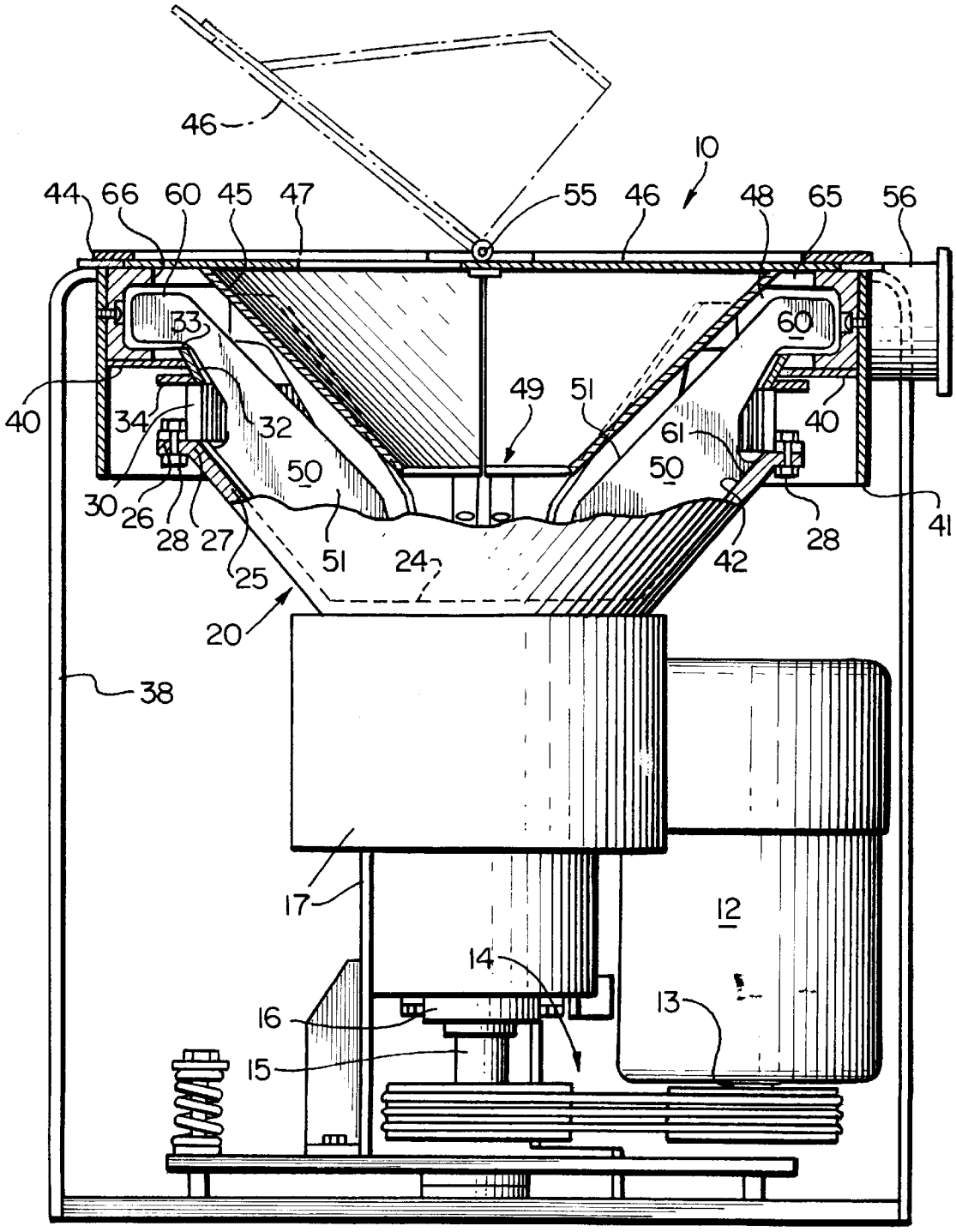
FIG. 1 shows a front, partial section view of a centrifugal separator apparatus including a replaceable separator screen according to the present invention.

Referring to the drawings and particularly to FIG. 1, there is shown a centrifugal separator device 10 which includes a motor 12 which has a drive shaft 13 connected by a belt and pulley drive assembly 14 to one end of the centrifugal separator drive shaft 15. The shaft 15 is disposed within a bearing assembly 16.

The remaining end of the drive shaft 15 is secured to a substantially cone or bell-shaped separator bowl 20. Upon actuation of the motor 12, the bowl 20 connected to the shaft 15 rotates. The cylindrical housing 17 encloses the lower end of the bowl 20 and the shaft 15.

A bottom wall 24 of the separator bowl 20, which has inner and outer wall surfaces, extends outwardly and terminates in a bowl wall 25. The wall 25 extends vertically upwardly and outwardly with a mounting flange 26 located at the upper end 27 of the bowl wall 25. A substantially cylindrical separator screen 30, which will be described in greater detail below, extends upwardly from the flange 26. The screen 30 permits discharge of lubricating liquid separated from the metal chips in the centrifuged separator bowl 20, the lubricant passing through the openings in the screen 30 while the metal chips are centrifuged upwardly past the screen 30. Liquid discharged through the openings in the screen 30 will be collected in a suitable collection chamber, not shown, preferably disposed within a casing chamber 38 in which the parts of the centrifugal separator device 10 are disposed. The screen 30 is secured to the flange 26 by means of a plurality of suitable fasteners 28.

A conical portion 32 is secured to the upper edge of the screen 30 and extends radially outward in an upward direction to a dispensing edge 33. A radially extending flange 34 is secured to the centrifugal separator bowl 20 intermediate the juncture between the conical portion 32 and the screen 30. A radially inwardly directed flange 40 is secured to a cylindrical outer wall support member 41 which depends from and is attached to the top of a chamber 38 as seen in FIG. 1.

A cover 44 is fixed in any desired manner to the upper edge of the chamber 38. In the particular embodiment of FIG. 1, the cover 44 includes an upper conical member 45 which is fixedly attached to and depends from the cover 44. A conical member 45 comprises two pivotable cone-shaped portions 46, 47 whereby the outer wall of the conical member 45 defines the inner wall of an annular chip collecting chamber 48 and the cylindrical support wall member 42 defines the outer wall thereof.

The cone 45 converges in a downward direction to a location spaced immediately above and within the separator bowl 20. An opening 49 at the bowl lower end of the conical member 45 defines an air inlet as well as a material inlet for a mix of lubricant plus chips, shavings or the like into the centrifuge separator device 10. Spaced blade assemblies 50 are securely fastened to and rotate with the rotatable separator bowl 20.

In a typical operation, metal chips and lubricating fluids to be separated are delivered to the top of the centrifuge 10 from a discharge end of a separator chute, not shown, which is well known in the prior art. The mixed chips and fluids enter the centrifuge 10 and pass through the opening 49 at the bottom of the conical member 45. The fluid mixed with the metal chips passes into the rotating separator bowl 20 where the materials to be separated are centrifuged outwardly and travel upwardly along both the internal surface of bowl wall 25 and the leading surfaces of the rotating blades 51 in blade assemblies 50. The lubricating fluid separates from the chips and passes through the screen 30 to a collection chamber (not shown) where the lubricating fluid is collected. The rotating blades 51 also serve to draw or pull fluid such as air downwardly through the opening 49 in the cone 45. The air then passes upwardly through the space between the outside surface of the cone 45 and the bowl 20. Following separation from the lubricating fluid, metal chips, shavings and the like, continue to be directed upward by the centrifugal action of the separating device 10 past the screen 30 and the dispensing edge 33 where the separated chips and shavings are directed out of the discharge chamber 48 and exit chute 56 to a collecting site.

The separator bowl 20 is shown with a plurality of spaced blade assemblies 50 disposed within, the blades 51 preferably being releasably fixed to the bowl 20. As disclosed in Nemedi U.S. Pat. No. 4,936,822, the disclosure of which is incorporated herein by reference, each blade assembly 50 includes a pad 61, which is secured to the bowl 20 and extends at right angles to the blade 51. The blade 51 projects upward beyond the location of the screen 30 into the chamber 48 of the discharge housing 65 as shown in FIG. 1. Each blade 51 includes a radially extending paddle 60 at its upper end, which is disposed within the scroll housing described hereafter.

The air movement within the scroll or discharge chamber 48 plus the blade paddles 60 serve to direct or otherwise move the chips through the annular-shaped portion of the discharge chamber 48 and exit chute 56. The discharge chamber 48 comprises annular-shaped support walls 40, 41 which support an annular wall or lining 66. As each blade 51 and its respective paddle 60 rotates in a clockwise direction, air and metal chips are swept, blown or pulled past the annular wall 66 and out the discharge outlet 56.

Figure 2:
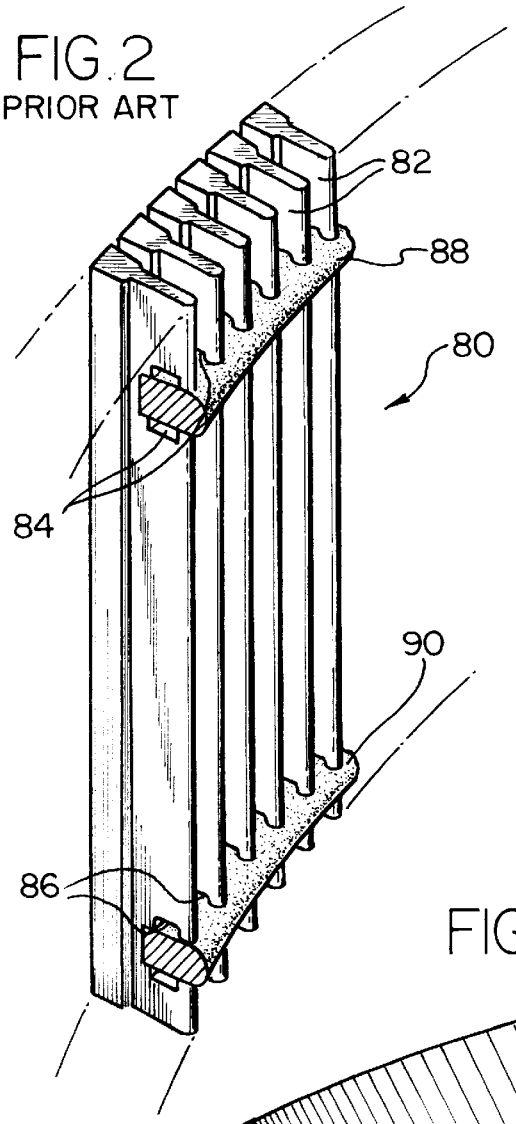
FIG. 2 PRIOR ART
FIG. 2 shows an isometric view of a portion of a prior art "wedge wire" separator screen.

Referring to FIG. 2, a portion of a prior art separator screen 80 used with the centrifugal separator device 10 is shown. The separator screen 80 is formed by first providing a plurality of drawn or extruded bars 82. The bars 82 are fabricated from a material that can be drawn or extruded into the bar shape. The extruded bar shape is then cut into individual lengths to form the bars 82. Upper and lower notches 84, 86 are cut into the back surface of each of the bars 82. Thereafter, the notched bars 82 are placed in a form whereby the requisite spacing between the bars 82 is carefully arranged to form the desired fluid passage openings. Once the bars 82 are aligned in their appropriate positions, upper and lower cross rods 88, 90 are placed in the upper and lower notches 84, 86, respectively, and welded to the bars 82 to complete the screen fabrication. One can appreciate that the time and effort associated with making a screen of this type are quite significant such that the screen and the conventional part separator device constitutes a costly component.

Figure 3:
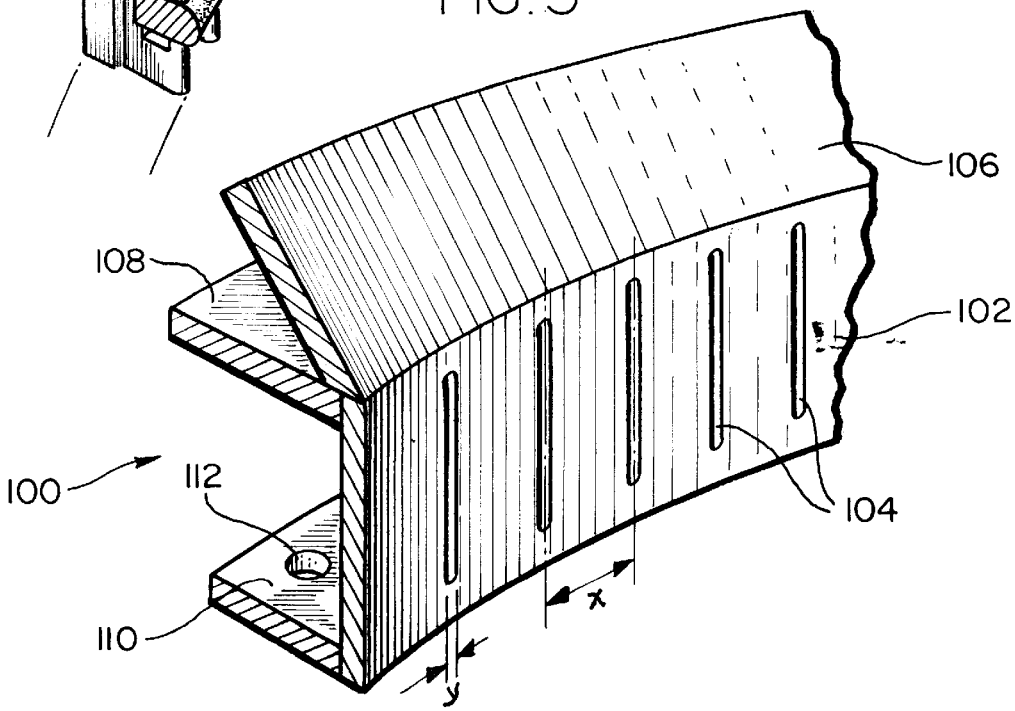
FIG. 3 shows an isometric view of a portion of a replaceable separator screen according to the present invention.

FIG. 3 illustrates an improved separator screen 100 according to the present invention. The separator screen 100 is formed from a cylindrical-shaped member 102, which can be formed in one or more component parts. The wall of the cylindrical-shaped member 102 has a plurality of fluid passage openings 104 passing therethrough. An optional conical portion 106 is secured to the upper edge of the cylindrical-shaped member 102, and extends radially outward in an upward direction. Upper and lower radially extending flanges 108, 110 are secured to the outer surface of the cylindrical-shaped member 102. The lower radially extending flange 110 has a plurality of holes 112 therethrough spaced about the lower flange 110 to align with corresponding holes in flange 26 to allow securing of the separator screen 100 to the separator bowl 20 by a plurality of fasteners 28.

The separator screen 100 is fabricated from a material with good wear-resistance characteristics, such as 304 stainless steel, 316 stainless steel, or AR500 carbon steel alloy. The cylindrical-shaped member 102 of the separator screen 100 is fabricated from a single flat piece of material or, if desired, from a plurality of screen segments. While the single piece or segments are still flat, the fluid passage openings 104 are cut into the material. Alternatively, these components can be cast with the openings 104 included therein, or the fluid passage openings 104 can be cut into the cylindrical-shaped member 102 after piece or segments have been rolled or bent into shape.

The fluid passage openings 104 have a median screen opening width y and are separated by a distance x between the center line from one opening 104 to the center line of an adjacent opening 104. The screen is made so that the spacing between the fluid passage opening 104 is maintained at a ratio of x/y. A ratio of greater than 18/1, and preferably 100/1 or more, is desired. By maintaining ratios of this magnitude, the separator screen 100 provides an increased surface wear area over which the fluids and solids travel across the screen. The increased surface area reduces the wear previously incurred with conventional screens because the centrifuged solids travel across an increased surface area not heretofore previously available.

After the openings 104 have been formed, the single piece or plurality of segments can be formed into the cylindrical-shaped member 102. When made of one piece, the cylindrical-shaped member 102 can be made sufficiently flexible such that it can be wrapped in a circular shape to fit the separator bowl 20. When formed of a plurality of screen segments, the segments are, if necessary, bent into an arcuate shape, and secured together to form the cylindrical-shaped member 102. After the cylindrical-shaped member 102 has been formed, conical portion 106 and upper and lower flanges 108, 110 can be welded thereto to form the separator screen 100.

The maximum width of the fluid passage openings 104 on the inside surface of the rolled cylindrical member 102 should be less than the width of the smallest metal chip, approximately 0.030 to 0.040 inches, to prevent unwanted chips from passing therethrough. The exact width of the fluid passage openings 104 will vary based on the thickness of the plates used to form the cylindrical shaped member 102 and the diameter of the separator bowl 20 at the upper end 27 of the bowl wall 25. For example, a first flat strip having a given thickness rolled to fit a 30 inch separator bowl 20 must have 0.060 to 0.080 inch opening width therethrough along the flat surface before shaping or rolling the screen to provide a y dimension of 0.030 to 0.040 inches at the inner surface of the cylindrical member 102. The width at the outside surface of the cylindrical member 102 will be somewhat greater than 0.060 to 0.080 inches. Similarly, a second flat strip having the same thickness rolled to fit a 40 inch separator bowl 20 will require opening widths of less than 0.060 to 0.080 inches due to the reduced curvature of the strip after rolling it to form the screen. The determination of the proper slot widths to prevent the passage of metal chips through the openings 104 will be obvious to those of ordinary skill in the art.

Figure 4:
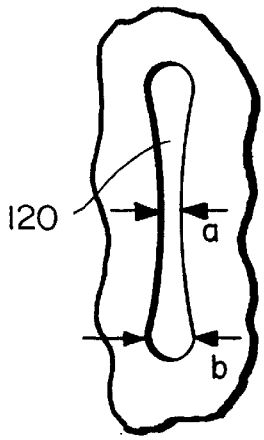
FIG. 4 shows a first alternative slot configuration for a separator screen according to the present invention.
Figure 5:
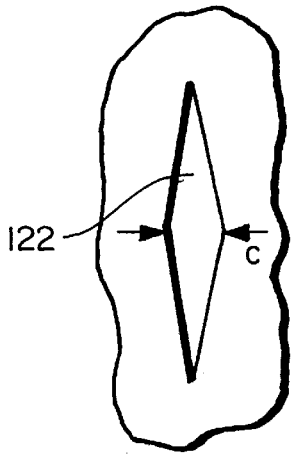
FIG. 5 shows a second alternative slot configuration for a separator screen according to the present invention.
Figure 6:
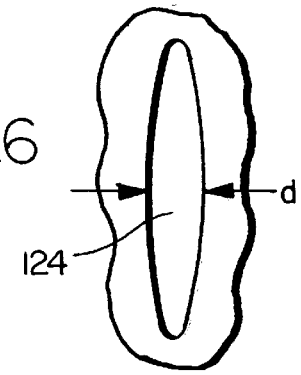
FIG. 6 shows a third alternative slot configuration for a separator screen according to the present invention.

The fluid passage openings 105 shown in FIG. 3 have a generally rectangular shape with radiused ends. FIGS. 4–6 illustrate alternative opening configurations for use with the separator screen according to the present invention. FIG. 4 shows a fluid passage opening 120 having an elongated hyperbolic shape with radiused ends. The opening 120 has a minimum width a in the center of the opening 120 and a maximum width b proximate each of the radiused ends which is less than the width of the smallest metal chip.

FIG. 5 illustrates another alternative fluid passage opening 122 in the shape of a diamond. The opening 122 has a maximum width c at the center of the opening and a converges to a point at either end. In this configuration, the median opening width y is equal to one-half the maximum width c. Yet another alternative fluid passage opening 124 is shown in FIG. 6 wherein the opening 124 is in the shape of an ellipse. The maximum width d of the opening 124 is equal to the lesser diameter d of the ellipse which is located at the center of the opening 124 and is smaller than the width of the smallest metal chip. Other fluid passage opening configurations that facilitate separation of a lubricant from the metal chips will be obvious to those of ordinary skill in the art and are contemplated by the inventors as having use in connection with the separator screen of the present invention.

While the present invention has been described with reference to the specific examples, which are intended to be illustrative only and not to be limiting of the invention, it will be apparent to those of ordinary skill in the art that changes, additions, and/or deletions may be made to the disclosed embodiment without departing from the spirit and scope of the invention.

What is claimed is:

1. A centrifuge separator for separating lubricating or other fluids from other materials, said centrifuge comprising:

a rotatable drive shaft;

a motor connected to and operable to rotate said drive shaft;

a separator bowl disposed within said centrifuge and connected to said rotatable shaft for rotation with said shaft;

said separator bowl including a bottom first wall and an upwardly and outwardly extending second wall having two ends, one of said second wall ends terminating at and joining said first bowl wall upon which materials to be separated are adapted to travel;

at least one blade disposed in said bowl and extending along said second wall;

a screen adapted to separate fluids from solid materials disposed in said bowl, said screen connected to said remaining end of said second bowl wall;

said screen comprising a member connected to said second remaining bowl wall end and adapted to rotate with said bowl;

said screen including a plurality of spaced openings, each opening having a median width dimension of "y" and the space between the center lines of adjacent openings being "x," with the ratio of x/y being at least 18/1; and, a solid material outlet assembly associated with said screen and adapted to direct solid materials following separation of fluid from said solid materials in said bowl.

2. A separator in accordance with claim 1 wherein the median "y" dimension is in the range of about 0.03–0.04 inches.

3. A separator in accordance with claim 1 wherein the median "y" dimension is about 0.04 inches.

4. A separator in accordance with claim 1 wherein the ratio of x/y is about 100.

5. A separator in accordance with claim 4 wherein the median "y" dimension is about 0.03 inches.

6. A separator in accordance with claim 1 wherein said screen is cast.

7. A separator in accordance with claim 1 wherein said screen is fabricated from a flat strip of material.

8. A separator in accordance with claim 1 wherein said screen further includes an upper flange and lower flange extending radially outwardly from said screen.

9. A separator in accordance with claim 1 in which said screen is releasably connected to said bowl.

10. A separator in accordance with claim 1 in which said screen comprises one piece.

11. A centrifuge separator for separating lubricating or other fluids from other materials, said centrifuge comprising:

a rotatable drive shaft;

a motor connected to and operable to rotate said drive shaft;

a separator bowl disposed within said centrifuge and connected to said rotatable shaft for rotation with said shaft;

said separator bowl including a bottom first wall and an upwardly and outwardly extending second wall having two ends, one of said second wall ends terminating at and joining said first bowl wall upon which materials to be separated are adapted to travel;

a plurality of spaced blades disposed in said bowl and extending along said second wall;

a screen having upper and lower edges and adapted to separate fluids from materials disposed in said lower edge of said screen being located at said remaining end of said second bowl wall; and, a cylindrical-shaped member having inner and outer surfaces and upper and lower edges and a plurality of spaced openings each having a median width dimension of "y" and the space between the center lines of adjacent openings being "x," with the ratio of x/y being at least 18/1.

12. A centrifuge separator in accordance with claim 11 and further including a cone-shaped member extending outward from the upper edge of said screen.

13. A centrifuge separator in accordance with claim 12 and further including:

an upper flange secured to said outer surface of said cylindrical-shaped member proximate an upper edge of said cylindrical-shaped member;

a lower flange secured to said outer surface of said cylindrical-shaped member proximate a lower edge adapted to releasably connect said screen to the top of said bowl; and, a material outlet assembly associated with said screen and adapted to direct materials following separation of fluid from said materials in said bowl.

14. A separator in accordance with claim 11 wherein the cylindrical-shaped member is cast.

15. A separator in accordance with claim 11 wherein the cylindrical-shaped member is fabricated from a flat strip of material.

16. A separator in accordance with claim 1 in which said separator includes a plurality of spaced blades disposed in said bowl for rotation with said bowl.

17. A separator in accordance with claims 1 or 11 in which materials to be separated are chips and the dimension "y" is less than the smallest chip to be passed through said separator.

18. A separator in accordance with claims 1 or 11 in which the "y" dimension is sized to preclude solid materials from any substantial passage through said "y" opening.

* * * * *